US010940660B2

(12) United States Patent
Aquarius

(10) Patent No.: US 10,940,660 B2
(45) Date of Patent: Mar. 9, 2021

(54) DEVICE AND METHOD FOR MANUFACTURING GAS FILLED CUSHIONS FROM PRECONFIGURED FILM MATERIAL

(71) Applicant: IDEEPAK HOLDING B.V., Stramproy (NL)

(72) Inventor: Pieter Theodorus Joseph Aquarius, Stramproy (NL)

(73) Assignee: STOROPACK HANS REICHENECKER GMBH, Metzingen (DE)

( * ) Notice: Subject to any disclaimer, the term of this patent is extended or adjusted under 35 U.S.C. 154(b) by 64 days.

(21) Appl. No.: 15/746,593

(22) PCT Filed: Aug. 3, 2015

(86) PCT No.: PCT/NL2015/050565
§ 371 (c)(1),
(2) Date: Jan. 22, 2018

(87) PCT Pub. No.: WO2017/023164
PCT Pub. Date: Feb. 9, 2017

(65) Prior Publication Data

US 2018/0207898 A1 Jul. 26, 2018

(51) Int. Cl.
*B31D 5/00* (2017.01)
*B65B 41/12* (2006.01)
(Continued)

(52) U.S. Cl.
CPC ..... *B31D 5/0073* (2013.01); *B65B 7/02* (2013.01); *B65B 41/12* (2013.01); *B65B 51/10* (2013.01);
(Continued)

(58) Field of Classification Search
CPC . B29C 65/02; B29C 65/0609; B29C 65/0618; B29C 65/18; B29C 65/7841;
(Continued)

(56) References Cited

U.S. PATENT DOCUMENTS 4,602,470 A * 7/1986 Stuart ..... E04G 1/06 182/186.8
5,810,487 A * 9/1998 Kano ..... B41J 3/28 400/83
(Continued)

FOREIGN PATENT DOCUMENTS

FR 2798981 3/2001
WO 2001/085434 A2 11/2001
(Continued)

*Primary Examiner* — Hemant Desai
*Assistant Examiner* — Jacob A Smith
(74) *Attorney, Agent, or Firm* — Preti Flaherty Beliveau & Pachios LLP

(57) ABSTRACT

A device for manufacturing gas filled cushions from preconfigured film material. The device comprises a housing, a film roll holder for supporting a roll of preconfigured film material in a rotatable manner, a gas supply unit, a sealing unit, and conveying means for conducting the film material away from the roll and for conducting said film material along the gas supply unit and the sealing unit in a conducting direction. The device is mountable to a stillage in multiple positions.

13 Claims, 3 Drawing Sheets

(51) Int. Cl.
*B65B 51/10* (2006.01)
*B65B 7/02* (2006.01)

(52) U.S. Cl.
CPC ..... *B31D 2205/0023* (2013.01); *B31D 2205/0047* (2013.01); *B31D 2205/0082* (2013.01); *B31D 2205/0088* (2013.01)

(58) Field of Classification Search
CPC ..... B29C 65/7873; B29C 65/7894; B29C 66/439; B29C 66/83423; B29C 66/96; B65B 3/02; B65B 31/02
USPC ..... 53/79, 284.7, 403, 456, 558
See application file for complete search history.

(56) References Cited

U.S. PATENT DOCUMENTS 5,934,862 A * 8/1999 Brown ..... B60P 1/38 198/833
6,804,933 B2 * 10/2004 Sperry ..... B31D 5/0073 156/145
7,313,901 B2 * 1/2008 Kakita ..... B65B 31/045 53/403
7,950,433 B2 * 5/2011 Sperry ..... B31D 5/0073 156/361
8,061,110 B2 * 11/2011 Wetsch ..... B31D 5/0073 53/79
8,635,836 B2 * 1/2014 Tan ..... B29C 65/223 53/79
2002/0108352 A1 * 8/2002 Sperry ..... B31D 5/0073 53/403
2003/0205026 A1 * 11/2003 Sperry ..... B29C 66/8242 53/403
2004/0020170 A1 * 2/2004 LaRocca ..... B65B 43/18 53/459
2005/0160699 A1 * 7/2005 Perkins ..... B31D 5/0073 53/403
2006/0059865 A1 * 3/2006 Yampolsky ..... B65B 61/007 53/403
2006/0090421 A1 * 5/2006 Sperry ..... B29C 65/7457 53/403
2006/0168912 A1 * 8/2006 Calogero ..... B29C 49/0047 53/403
2006/0218879 A1 * 10/2006 Garceau ..... B31D 5/0073 53/403
2006/0236654 A1 * 10/2006 Lorsch ..... B31D 5/0073 53/79
2007/0011989 A1 * 1/2007 Sperry ..... B29C 66/83413 53/403
2008/0141620 A1 * 6/2008 Szabo ..... B29C 66/1122 53/79
2009/0057272 A1 * 3/2009 Modgil ..... B65D 7/32 217/17
2010/0096290 A1 4/2010 Frayne et al.
2010/0127112 A1 * 5/2010 Aquarius ..... B65H 20/02 242/564.4
2010/0313524 A1 * 12/2010 Pape ..... F25C 5/187 53/459
2011/0247725 A1 * 10/2011 Frayne ..... B31D 5/0073 141/10
2011/0271640 A1 11/2011 Sperry et al.
2012/0279174 A1 * 11/2012 Aquarius ..... B29C 66/439 53/403
2012/0304595 A1 * 12/2012 Dovner ..... B65D 81/2015 53/79
2014/0012411 A1 1/2014 Sperry et al.
2015/0075114 A1 * 3/2015 Murch ..... B29D 22/02 53/52
2017/0072655 A1 * 3/2017 Aquarius ..... B65B 41/12
2017/0282480 A1 * 10/2017 Wetsch ..... B31D 5/0073
2019/0009476 A1 * 1/2019 Sperry ..... B65H 20/02

FOREIGN PATENT DOCUMENTS

WO 2006/003524 A2 1/2006
WO 2006/101391 A1 9/2006
WO WO2015133897 A1 9/2015

* cited by examiner

DEVICE AND METHOD FOR MANUFACTURING GAS FILLED CUSHIONS FROM PRECONFIGURED FILM MATERIAL

The invention relates to a device for manufacturing gas filled cushions, from preconfigured film material.

Such devices are for instance known from patent publications WO 01/85434, WO 2006/003524, and WO 2006/101391 of applicant. Such a known device can be used for instance for sealing cushions or bags manufactured from film material tight, after these have been inflated with air or another suitable filling medium. The thus obtained cushions or bags can be used as, for instance, filling material in packages, for the protection of products included in these packages.

Generally, known devices for manufacturing cushions filled with air or any other suitable filling medium such as a gas or a gas mixture, i.e. gas filled cushions, from preconfigured film material comprise a housing, a film roll holder for supporting a roll of preconfigured film material in a rotatable manner, a gas supply unit, a sealing unit, and conveying means for conducting the film material in a conducting direction away from the roll and along the gas supply unit and the sealing unit.

An advantage of such known devices may lie in that gas filled cushions or bags can be filled at a packaging facility where the obtained gas filled filling material is used to pack products in packages. Hence, gas filled packaging cushion material can be manufactured at location, thereby counteracting transport of voluptuous gas filled cushions from a manufacturing plant to a packaging facility.

Normally, the known devices are arranged as table top models for placement on top of a worktop of a working bench and/or for placement on another stillage, such as a supporting standard. Thereto, the device is generally provided with one or more support structures for supporting the device, which support structure(s) can comprise multiple adjustable feet for placing the device relatively sturdily on top of a working surface. Usually, said support structure is relatively wide in order to counteract that that the device tips over accidentally. Due to its relatively wide support structure, a drawback of known devices can be that they are not very versatile, which can for instance result in that the known devices cannot be placed on any available workbench at a packaging facility.

Further, it is noted that in the known devices, the film roll holder is extending in a direction laterally away from the housing of the device, especially seen in the conducting direction extending to the left of the housing. Therefore, and due to the width of the film roll, it can be difficult for a user to control the device and/or to reach an input unit provided at the housing of said device. This may for instance be the case when a user of the device is forced to be located at a certain side of the device, such as a side opposite to a preferred side, which latter can be a side from which it is intended to control the device. This may for example be due to the layout of a packaging facility, which layout may require placement of the device in a certain position in order to enable that manufactured gas filled cushions will leave the device in a desired direction, e.g. towards a place where the actual packaging takes place.

An object of the invention is to provide an alternative device for manufacturing gas filled cushions from preconfigured film material, comprising a housing, a film roll holder for supporting a roll of preconfigured film material in a rotatable manner, a gas supply unit, a sealing unit, and conveying means for conducting the film material away from the roll and for conducting said film material along the gas supply unit and the sealing unit, in a conducting direction. It is an object of the present invention to alleviate or solve at least one of the drawbacks of the known devices of the type described hereinabove. In particular, the invention aims at providing a device for manufacturing gas filled cushions from preconfigured film material, which is relatively versatile and/or which can be used relatively easily, preferably substantially irrespectively of the layout of a packaging facility.

These and further objects can be at least partly achieved by arranging the device to be mountable to a stillage, such as a workbench or the like, in multiple positions such that in one of said multiple positions a central axis of the film roll holder will extend in a different direction with respect to the conducting direction and/or with respect to a longitudinal direction of the housing than in another one of said multiple positions, and/or such that, in one of said multiple positions, the conducting direction and/or said longitudinal direction of the housing will—with respect to the direction of the central axis of the film roll holder—extend in a different direction than in another one of said multiple positions.

By providing a device having a housing being mountable to a stillage, such as a workbench or the like, in said multiple positions, it can be enabled that the device can be installed in a desired position or in multiple desired positions. As a result of installing the device is a desired position, e.g. in a position in which the film roll holder is extending to the right instead of to the left, it can for instance be facilitated that a user of the device can control said device in a relatively ergonomic manner. Further, by enabling that the housing of the device can be installed in different positions, a relatively versatile device can be provided for. Moreover, by mounting the housing to a workbench, the device can be placed relatively sturdily, which may increase operational safety of the device and/or the packaging facility where it is placed and/or which may facilitate a relatively safe working environment.

Advantageously, the housing may be mountable such that the central axis of the film roll holder can extend in different directions with respect to the horizontal plane and/or with respect to a vertical plane. Additionally or alternatively, the housing may be mountable such that the conducting direction and/or the longitudinal direction of the housing can extend in different directions with respect to a horizontal plane and/or with respect to a vertical plane.

For example, the device may be of such design that in a first position of the device, the film roll holder can extend from the housing of the device in a substantially horizontal direction, and that in a second positon of the device, the film roll holder can extend from the housing at an angle with the horizontal plane, especially in an upward direction. For example, said angle can be substantially 45 degrees, e.g. in case of a substantially octagonal prism shaped housing. Alternatively, for instance in case the housing is of a substantially hexagonal prism shaped design, the film roll holder may in the second position extend at an angle of substantially 60 degrees with the horizontal plane, or, for instance in case of housing of a substantially decagonal prism shape design, the film roll holder may in a second position extend at an angle of substantially 36 degrees and/or may in said second position or a further position extend at an angle of substantially 54 degrees with the horizontal plane, especially in an upward direction. By allowing the device to be installed such that the roll holder can extend in a slanting direction, it can be facilitated that a roll of preconfigured film material, which usually are relatively heavy, can be installed in a relatively simple and/or relatively ergonomic manner.

It is noted that the device may preferably be arranged to be installed in one or more further positions, for example in at least a position in which the roll holder can extend substantially vertically upwards.

Further it is noted that the film roll holder may extend in a direction substantially transverse to the longitudinal direction of the housing, e.g. the film roll holder may extend in a direction substantially transverse to a direction extending from one end face of the housing to the opposite end face of said housing.

It is preferred that the housing can be provided with multiple mounting surfaces and/or multiple fasteners facing in different directions for mounting the device in multiple positions. Hence, it can be facilitated that the housing of the device can be mounted in different positions relatively easily. Advantageously, multiple side surfaces of the housing, especially a substantially prism shaped housing, can be provided with fasteners for mounting to the device to a stillage and/or at least on support structure.

In embodiments, the housing can be substantially shaped as a prism. Preferably, said housing can be shaped as a regular prism or right prism, especially a right regular prism. Advantageously, at least two of the side surfaces interconnecting two end faces of the substantially prism shaped housing can each be arranged as a mounting surface for mounting the device to a stillage, such as a workbench or the like, and/or to one or more support structures. For example, by arranging at least two side surfaces, e.g. two opposite side surfaces, as mounting surfaces, the housing may be installed in at least two different positions in each of which positions a central axis of the substantially prism shaped housing is extending in substantially the same direction, but in each of which the film roll holder is positioned so as to have its central axis extend into another direction, e.g. in one of two opposite directions in a case that the respective two mounting surfaces or positioned opposite of each other. For example, in case that the roll holder is extending to the left of the housing with respect to the conducting direction when the substantially prism shaped housing is mounted with a first mounting surface onto a top face of a worktop or so-called working surface, said roll holder can be extending to the right of the housing with respect to said conducting direction when the substantially prism shaped housing is mounted with a second mounting surface onto said top face, wherein said second mounting surface is formed by a side surface opposite of the side surface of the substantially prism shaped housing forming said first mounting surface.

Advantageously, the side surfaces of the housing may be spread substantially uniformly around the circumference of a cross-section of the housing. Preferably, the cross-section and/or end faces of the housing can be formed as a substantially equilateral polygon.

It is noted that all side surfaces of the housing may have substantially the same width, seen in a the circumferential direction of cross-section of said housing.

Advantageously, the substantially prism shaped housing can be substantially shaped as an octagonal prism. It is noted that in this description an octagonal prism can be understood at least as a prism having octagonal shaped end faces. Preferably, the octagonal end faces can be shaped as a regular convex polygon. By arranging at least three side surfaces of said housing, each substantially extending in a plane being non-parallel with respect to the planes of the respective other two side surfaces, which at least three side surfaces can preferably be three adjacent side surfaces, as being mounting surfaces, the housing can be installed to a stillage such as e.g. a workbench in at least three substantially different positions. For example, in case the central axis of the housing is extending substantially in a horizontal direction, in each of the at least three different installing positions of the housing, the central axis of the film roll holder may extend in a substantially different direction, e.g. a substantially horizontal direction, a substantially vertical direction and a diagonal direction which is inclined with respect to a horizontal plane, e.g. at an angle of substantially 45 degrees in case of an octagonal prism.

Alternatively, other prism shapes are possible. For example, the substantially prism shaped housing can be substantially shaped as a substantially pentagonal, hexagonal, heptagonal, nonagonal or a decagonal prism.

In embodiments, the device can be arranged such that the conducting direction is extending in a direction parallel to a central axis of the housing and/or a longitudinal direction extending from one end face of the substantially prism shaped housing to the other end face.

By providing an end face of the prism with an input unit, preferably a control panel, it can be enabled that said input unit can be in a place relatively easy to reach irrespective of a position in which the housing is installed. The input unit may be a unit arranged for providing the device with operational input and/or for setting the device. For example, the input may relate to starting, pausing or stopping the device, setting a desired sealing temperature, setting an amount of gas/air, setting a length of film material to be processed by the device, setting a film material conducting speed, inputting a compartment or pocket length and/or volume, setting a desired number of compartments to be filled, and/or selecting one or multiple pre-set operation option, etc. Advantageously, said control panel can be placed relatively centrally which respect to said end face.

By further arranging the device for adjusting the position of the input unit with respect to the housing, preferably such that the position of the input unit can be adjusted such that an underside of said input unit can be facing substantially downwards and/or can be facing substantially towards a user during use, the input unit is not only accessible relatively easily, but it may also be relatively easy to look at it, e.g. without reading upside-down and/or without a user needing to tilt his head to a relatively large extent. Preferably, the input unit can be provided at an end face of a substantially prims shaped housing.

As an example, the input unit can be rotatable with respect to the housing, e.g. in a stepwise manner, preferably with steps corresponding to the number of side surface. For example, in the case of a prism shaped housing having multiple side surfaces, the input unit provided at one of its end faces can be arranged to be rotated in a number of substantially equally sized rotational steps, especially steps corresponding to the number of side surfaces. For instance, in case of a prism having n side surfaces, the rotational steps may each cover about $1/n^{th}$ of 360°. An octagonal prism shaped housing having eight side surfaces may thus have an input unit being rotational in steps that can cover about $1/8^{th}$ of 360°, i.e. about 45°. Further, the input unit can be releasably connected to one of the end faces and can be arranged to be put back at said end face in a rotated position.

Additionally or alternatively, the input unit may be releasably connected to one end face of the substantially prism shaped housing and the device may be arranged such as to enable releasing the input unit from said one end face and connecting it to the other end face. As a result, it may be enabled that said input device can be reached even more easily. It is noted that an input device which may be attached to either of the two end faces of a substantially prism shaped housing can be advantageous for instance when said housing is to be installed with its central axis in a substantially vertical direction in which a first end face is substantially facing upwards and the other end face is substantially facing in a downward direction. In that case, an input device provided at a downward facing end face which may be hardly reachable for a user, can be replaced to an upward facing end face of the housing. Advantageously, the input unit can then also be rotatable, such that a bottom portion of the input unit can be turned to the user, such that he does not need to read upside down.

Preferably, a central axis of the film roll holder can be extending transverse to a side surface of the housing and can be positioned substantially in the middle of the width of said side surface seen in a direction transverse to a longitudinal direction extending from one end face of the substantially prism shaped housing to the other end face. As a result, the housing can be relatively versatile and/or it can be facilitated that a film roll with a relatively wide diameter can be placed on said holder without extending beyond the width of the housing in a direction parallel with the width of the respective side surface. Hence, when the housing is mounted with a second side surface attached to a top surface of a worktop, which second side surface is extending substantially transverse to said first side surface from which the film roll holder is extending laterally, it can be counteracted that the film roll drags over said worktop.

Advantageously, the device can be mounted to a workbench or other stillage. For example, the device, especially its housing, can be installed with a mounting surface thereof mounted onto a top surface or bottom surface of a worktop of the workbench. The film roll holder may then for instance extend substantially horizontally or substantially vertically, or may substantially incline in an upward or downward direction, respectively, e.g. substantially 45° with respect to the horizontal plane. As another example, the device, especially its housing, can be mounted against another part of the workbench, e.g. another workbench surface, such as a substantially vertically extending surface, and/or a beam or bar of the workbench. For instance, the device or its housings can be mounted onto a substantially vertically extending side surface of an elongated standard or leg or onto a substantially horizontally extending beam or crossbar, e.g. onto an elongated side surface thereof.

The invention also relates to a stillage, such as a workbench or the like, provided with at least one device for manufacturing gas filled cushions from preconfigured film material, wherein the device is a device as described herein.

Further, the invention relates to a method for manufacturing gas filled cushions from preconfigured film material, wherein the gas filled cushions are manufactured by means of a device as described herein and/or a stillage provided with such device.

Advantageous embodiments of the invention are described below and in the appended claims.

By way of non-limiting examples only, embodiments of the present invention will now be described with reference to the accompanying figures in which.

The embodiments disclosed herein are shown as examples only and should by no means be understood as limiting the scope of the claimed invention in any way. In this description, the same or similar elements have the same or similar reference signs. The device shown and the operation thereof will merely be explained in as far as required for a proper understanding of the present invention. For more detailed explanations, for instance a more detailed explanation of the preconfigured film material and-or the conveying means, reference is made to the earlier mentioned patent publications WO 01/85434, WO 2006/003524, and WO 2006/101391, which are understood to be included herein by reference.

Figure 1:
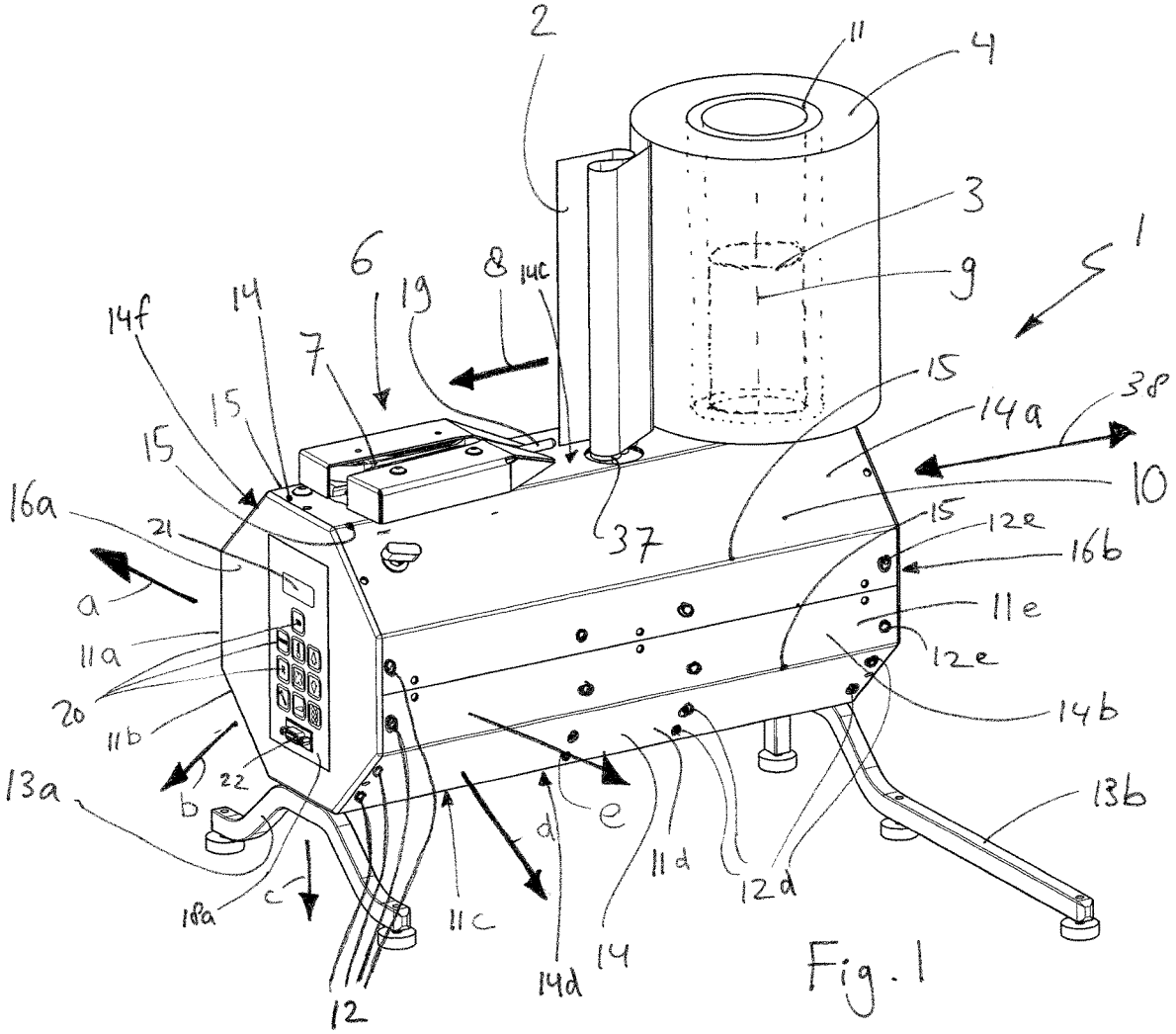
FIG. 1 shows a schematic perspective view of an embodiment of a device for manufacturing gas filled cushions according to an aspect of the invention.
Figure 2:
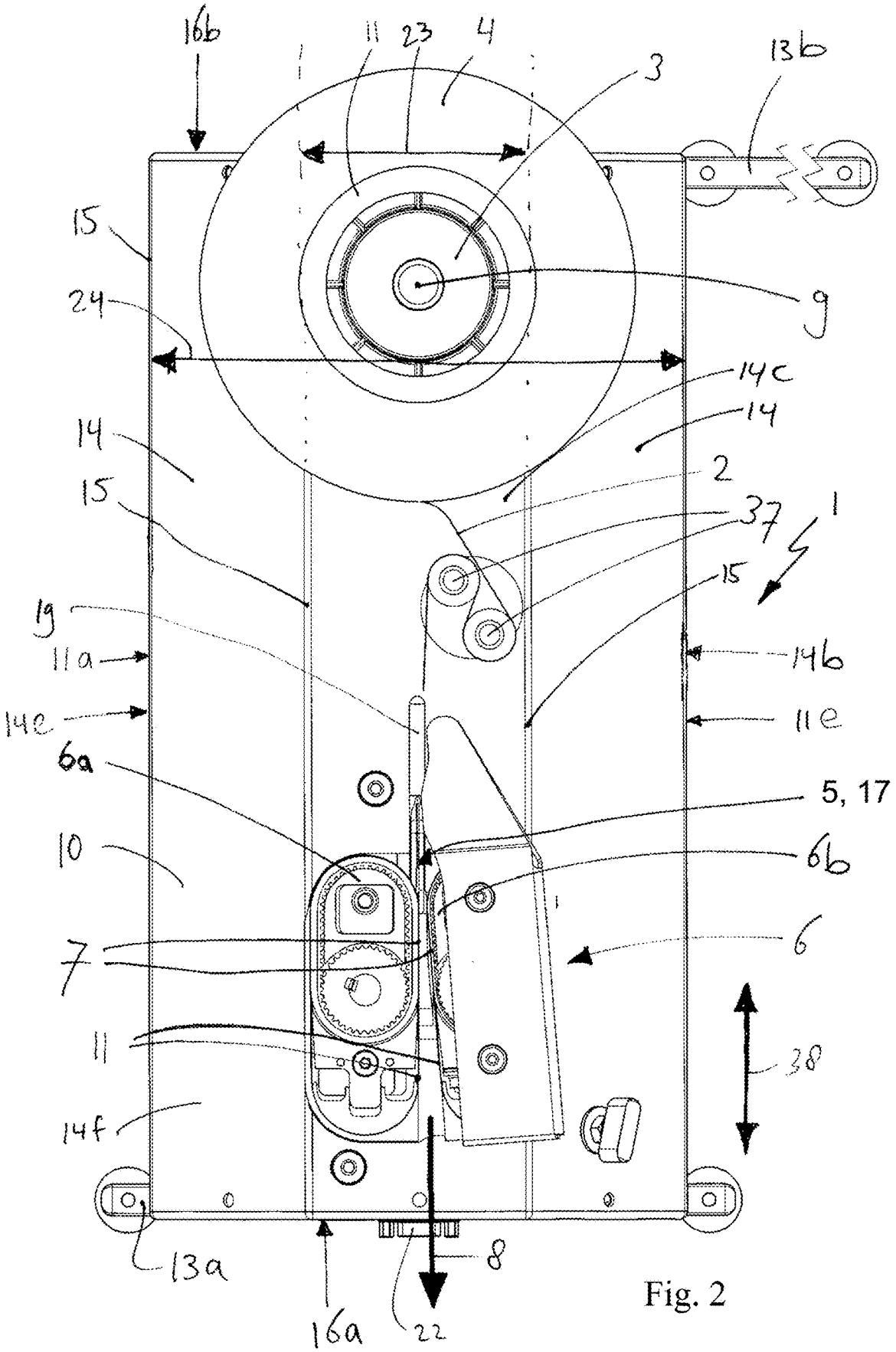
FIG. 2 shows a schematic top view of the device of FIG. 1.

FIGS. 1 and 2 show, in a schematic perspective view and a schematic top view, respectively, a device 1 for manufacturing gas filled cushions from preconfigured film material 2. Preferably the cushions are manufactured in a strip wise manner, wherein a manufactured cushion or group of cushions can be separated from an adjacent cushion or group of cushions, preferably by means of rows of perforations provided in said preconfigured film material 2. The device 1 of the current invention comprises a housing 10, which may be substantially prism shaped. The device 1 also comprises a film roll holder 3 for supporting a roll 4 of preconfigured film material 2 in a rotatable manner. The film roll holder 3 may extend from the housing 10. It is noted that the film roll holder may for instance comprise a substantially round cylindrically holder, which may be bearing-mounted with respect to the housing 10. Additionally or alternatively, the holder 3 may be arranged to hold a core 11 of the roll 4.

The preconfigured film material 2 may be provided in a rolled up form, e.g. rolled up onto a cardboard core. Further, it is noted that said film material 2, especially thermoplastic material, can be preprocessed tubular foil rolled onto a roll in a flat condition. Preferably, the preconfigured film material 2 can comprise pockets or so-called compartments which can be divided from each others by means of seals, seams or welds and can have an open side through which gas, preferably air, can be inserted into said pocket or compartment. Although the gas can be or comprise air, the gas may alternatively or additionally be or comprise any other suitable gas or gas mixture.

Further, the device 1 comprises a gas supply unit 5 which is arranged for inflating pockets in the preconfigured film material 2. The gas supply unit 5 may comprise a gas injector opening 17 for blowing the gas into the pockets. Said opening 17 can be provided at a guiding means 19, such as a guiding pin 19 for guiding the film material 2 to the gas injector opening 17 and/or to a sealing unit 6 of the device 1.

In this context, it is thus noted that the device 1 comprises a sealing unit 6, which can be arranged to seal Horn off the opening of the pocket during and/or after filling said pocket at least partly with air or another gas.

Further, the device 1 comprises conducting means 7 or so-called conveying means 7 for conducting or conveying the film material 2 in a conducting or conveying direction 8 away from the roll 4 and along the gas supply unit 5 and the sealing unit 6. For example, the conveying means 7 may be arranged to pull the material 2 from the roll through and/or along the gas supply unit 5 and the sealing unit 6. In embodiments, the conveying means 7 may comprise cooperating rotating or circulating elements between which the processed film material 2 can be calmingly engaged. Said cooperating rotating or circulating elements can for instance comprise wheels and/or rotating belts. In embodiments, said cooperating elements of the conveying means 7 can be integrated with the sealing unit 6.

Furthermore, the device 1 can be provided with tightening means 37 and/or alignment means 37 for tightening and/or aligning, respectively, the film material 2 conducted to the gas supply unit 5 and/or sealing unit 6.

It is noted that the sealing unit 6 can for example comprise heating means, e.g. a sealing wire, such as a Teflon band, provided in or at a sealing block and a counter block arranged opposite the sealing block and provided with a layer of resilient material provided on a side of the counter block facing the sealing block, such that two layers of the preconfigured film material 2 to be sealed together can be heated and pressed to each other in order to seal or weld them together.

As another example, in embodiments, the sealing unit 6 can comprise two blocks 6*a*, 6*b* suspended opposite each other. The conveying means 7 of the device 1 can then be arranged for guiding the film material 2 between these blocks 6*a*, 6*b*, wherein between the blocks 6*a*, 6*b* at least one heating element 11, such as a heated wire 11, is provided and at least one circulating belt 7, which is advanced along the blocks, and wherein the circulating belt is built up from at least one layer of resilient material. In such case, the circulating belt 7 can both be used as a conveying means 7 and as a means for pressing together layers of the heated film material to be sealed.

Further, the device 1 is arranged to be mountable to a stillage 23 (see FIG. 3), such as a workbench or the like, in multiple positions such that, in one of said multiple positions 30-36, a central axis 9 of the film roll holder 3 will extend in a different direction with respect to the conducting direction 38 and/or with respect to a longitudinal direction of the housing 10 than in another one of said multiple positions 30-36, and/or such that, in one of said multiple positions 30-36, the conducting direction 8 and/or said longitudinal direction 38 of the housing 10 will—with respect to the direction of the central axis 9 of the film roll holder 3—extend in a different direction than in another one of said multiple positions. It is noted that the workbench or other stillage 23 can for example be a packing bench or packing table, for instance provided in a packaging facility.

In order to facilitate such mounting, the housing 10 can be provided with multiple mounting surfaces 11*a*-11*e* facing in different directions a, b, c, d, e for mounting the device 1 in multiple positions. Additionally or alternatively, the housing 10 can be provided with multiple fasteners 12, couplers 12, connectors 12 or so-called mounting means 12 for mounting or attaching the housing 10 to a workbench or other stillage in multiple positions such that a central axis 9 of the film roll holder 3 will—in one of said multiple positions—extend in a different direction with respect to the conducting direction 8 and/or with respect to a longitudinal direction 38 of the housing 10 than in another one of said multiple positions, and/or such that the conducting direction 8 and/or said longitudinal direction of the housing—in one of said multiple positions—will extend in a different direction than in another one of said multiple positions with respect to the direction of the central axis 9 of the film roll holder 3. Advantageously, the multiple fasteners are provided at multiple surfaces of the housing 10 of the device 1. For example, a number of the multiple mounting surfaces 11*a*-11*e*, e.g. all mounting surfaces, can be provided with the fasteners 12, connectors 12 or so-called mounting means 12.

In embodiments, such as the one shown in FIG. 1, the fasteners 12 can be formed by mounting holes, such as bores, which may be provided with internal screw thread. However, the device 1 may be provided with any other suitable fasteners, such as for instance protruding screw bolts, etc.

In embodiments, the device 1 can comprise one or more support structures 13 such as legs, especially support structures releasably connectable to the housing 10, preferably at least partly by means of the fasteners 12 provided at a respective mounting surface. In FIGS. 1 and 2, a first mounting surface 11*c* is attached to support structures 13*a*, 13*b*, for example by means of bolts screwed into the openings 12. However, the mounting surface 11*c* can also be mounted directly onto a stillage, for example by means of bolts extending upwardly from a worktop of the workbench.

Advantageously, as noted before, the housing 10 can be substantially shaped as a prism. Preferably, said housing 10 can be shaped substantially as regular prism or right prism, especially a right regular prism. It is noted that a right prism can be understood as a prism in which the side surfaces 14 and the edges joining 15 two adjacent side surfaces 14*a*, 14*b* are substantially perpendicular to base faces 16*a*, 16*b* of the prism. Further, it is noted that a regular prism can be understood as a prism having regular polygons as end faces 16*a*, 16*b*. Here, the substantially prism shaped housing 10 is substantially shaped as an octagonal prism. This is, the prism has substantially octagonal end faces 16*a*, 16*b*. It is noted that the octagonal end face can preferably be shaped as a substantially regular convex polygon.

The housing 10, especially a substantially prism shaped housing, can be of elongated design. Preferably, such housing has a longitudinal direction, e.g. a central axis of the substantially prism shaped housing, which extends in a direction substantially parallel with the conducting or so-called conveying direction 8. The device 1 can be arranged such that the conducting direction 8 is extending in a direction substantially parallel to a longitudinal direction extending from one end face 16*a* of the substantially prism shaped housing 10 to the other end face 16*b*.

As can be seen in FIG. 2, the film roll holder 3, the gas supply unit 5, and the sealing unit 6 can in preferred embodiments extend outwards from a single side surface 14*c* of the housing 10. Advantageously, all side surfaces 14 but said single side surface 14*c* can be arranged as mounting surface 11. Alternatively, all side surfaces 14 but the side surface 14*c* provided with the film roll holder 3, the gas supply unit 5 and the sealing unit 6 and the side surfaces 14*a*, 14*f* adjacent to said side single surface 14*c* can be arranged as mounting surface 11*a*-11*e*. However, in alternative embodiments, another number of side surfaces 14 can be arranged as mounting surface 11 and/or a side surface 14*c* provided with at least one of the film roll holder 3, the gas supply unit 5 and the sealing unit 6 may be arranged as a mounting surface 11.

As is for instance shown in FIG. 1, an end face 16 of the prism can be provided with an input unit 18, preferably a control panel, which may comprise buttons 20 and/or a touch screen. It is noted that the input unit 18 may comprise means for providing feedback to a user, such as a display 21 and/or a touch screen. Additionally or alternatively, the input unit 18 may be provided with a connector 22 such as a plug or a socket for electrically connecting the input device to a input device such as a computer or electronic handheld device.

Advantageously, the device 1 can be arranged for adjusting the position of the input unit 18. Preferably, the device 1 can be arranged for adjusting the position of the input unit 18 such that an underside 18*a* of said input unit 18, e.g. a bottom 18*a* of a control panel, can be faced substantially downwards. This can for instance be the case when the conducting direction 8 and/or a central axis or longitudinal direction of the housing 10, e.g. a substantially prism shaped housing 10, is extending substantially in a horizontal direction, as is the case in FIG. 1. By positioning the input device 10 such that the underside 18*a* of said input unit 18 is facing downwards, it can be enabled that for instance text and/or symbols present on the display and/or the buttons can be substantially upright. Additionally or alternatively, the device 1 can be arranged for adjusting the position of the input unit 18 such that, during use, an underside 18*a* of said input unit, e.g. a bottom of a control panel, can be faced substantially towards a user. This can for instance be the case when the conducting direction and/or a central axis or elongated direction of the housing 10, e.g. a substantially prism shaped housing, is extending substantially in a vertical direction. Then, the input unit 18 can be provided at an end face 16 extending substantially in a horizontal plane and facing substantially in upward direction.

In order to arrange the device 1 for adjusting the position of the input unit 18, the input unit 18 can for instance be rotatable, especially in a stepwise manner. Here, the input unit is substantially formed as a polygon having a shape and/or size corresponding with the end face of the housing 10. Said polygonal shaped input unit 18 can be rotated around a longitudinal central axis of the housing.

Although the input unit 18 is here of polygonal design and of a size corresponding to the size of the end face, the input unit 18 may in alternative embodiments have a different shape. For example, it can be of round design and have a diameter smaller than the width of the end face. For instance in such case, the input unit 18 may be rotatable in a continuous manner, i.e. in a non-stepwise manner.

Alternatively or additionally, the input unit 18 can be releasably connected to one or both of the end faces 16. When the input unit 18 is releasably connected to one end face 16*a* of the substantially prism shaped housing 10 and the device 1 is arranged such as to enable releasing the input unit 18 from said one end face 16*a* and connecting it to the other end face 16*b*, it can be facilitated that the input unit 18 can be positioned at a desired end face. For example, the input unit 18 can be positioned at an end face facing upwardly of a housing positioned in a substantially vertical position, irrespectively of the fact whether the conducting direction 8 is directed upwards or downwards.

Preferably, at least two side surfaces 14 interconnecting two end faces 16 of the substantially prism shaped housing 10 are arranged as a mounting surface 11 for mounting the device 1, e.g. its housing 10, to a stillage, such as a workbench or the like.

Further, a central axis 9 of the film roll holder 3 may be extending transverse to a side surface 14*c* of the housing 10 and may be positioned substantially in the middle of the width 23 of said side surface 14*c* seen in a direction transverse to a longitudinal direction extending from one end face 16*a* of the substantially prism shaped housing 10 to the other end face 16*b*. By arranging the film roll holder 3 in the middle of the width 23 of said side surface 14*c*, the roll 4 of preconfigured film material 2 can be positioned substantially in the middle of the width 24 of the housing 10. Hence, a relatively large roll 4 having a relatively large diameter can be used without said roll extending beyond the width 24 of the housing 10, which can be advantageous, for instance when the housing is mounted with one of its side surfaces 14*b*, 14*e*, which are extending substantially transverse to the side surface 14*c* from which the roll holder 3 extends, against a workbench or the like.

Figure 3:
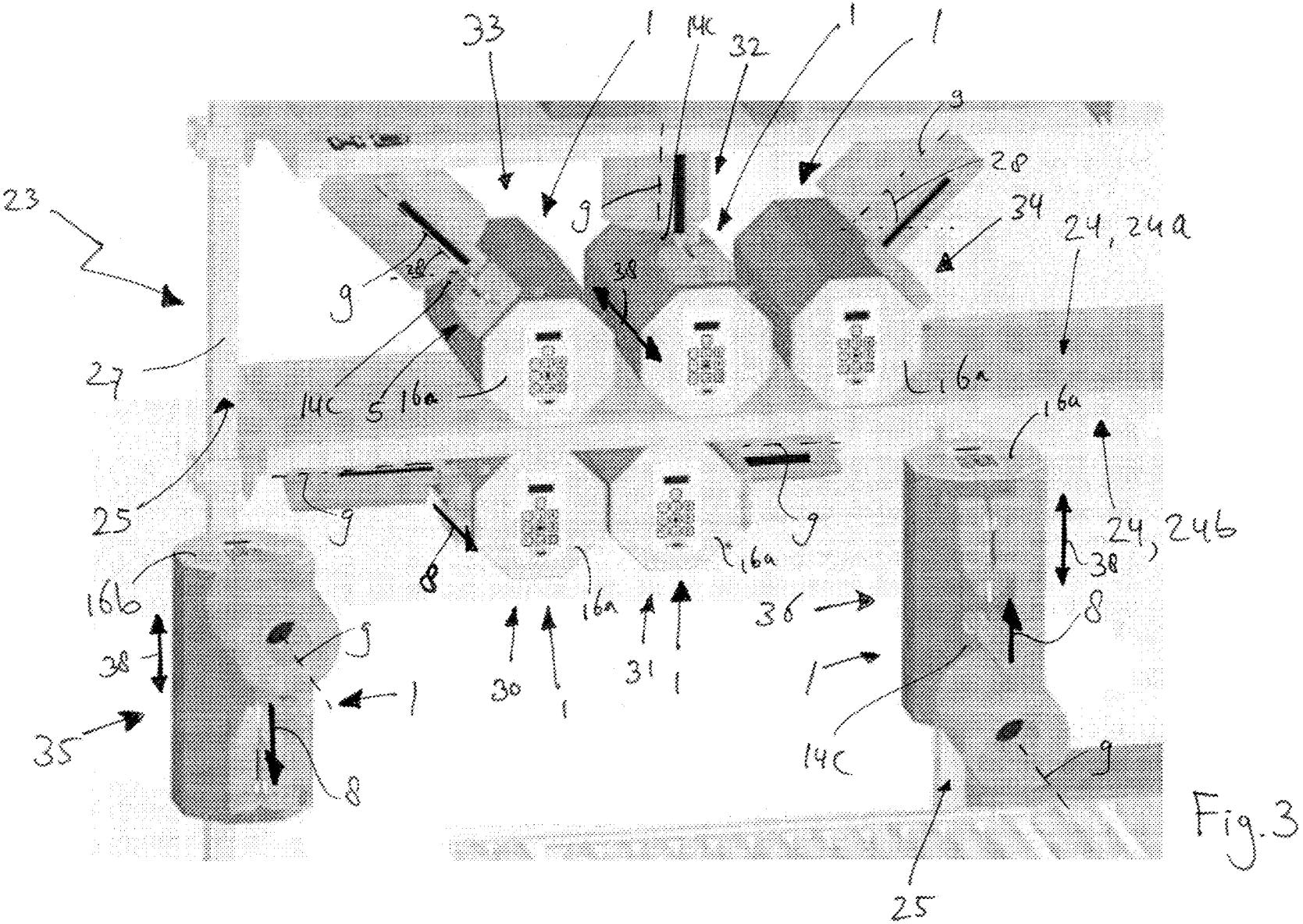
FIG. 3 shows a schematic view of a workbench provided with the device of FIGS. 1 and 2.

FIG. 3 shows a schematic view of a stillage 23, such as a workbench, rack or the like. Here, the stillage 23 is provided with seven devices 1 such as the one shown in FIGS. 1 and 2. However, in embodiments, a stillage 23 according to the present invention can be provided with at least one device 1 as disclosed in the present application. Advantageously, the device 1 can be mounted with at least one of its side surfaces 14, which can be arranged as a mounting surface 11, to a surface 24, 25 of the stillage 23, preferably to a surface 24 extending substantially horizontally or a surface extending substantially vertically 25. For example, such surface 24, 25 may be a top face 24*a* or a bottom face 24*b* of a worktop 26 of a workbench or a side face 25 of a beam, stand 27 or leg of the stillage 23. As can be seen in FIG. 3, the device 1 can be mounted to the stillage 23 in multiple positions 30-36 such that a central axis 9 of the film roll holder 3 in one of said multiple positions 30-36 can extend in a different direction than in another one of said multiple positions 30-36 with respect to the conducting direction 8 and/or with respect to a longitudinal direction 38 of the housing 10. Further, in the different positions 30-36, also the conducting direction 8 can extend in different directions, e.g. with respect to the direction of the central axis of the film roll holder and/or with respect to a horizontal plane.

In advantageous embodiments, the device 1 is positioned 33, 34 such that the film roll holder 3 is inclined under angle 28 with respect to the horizontal plane. Preferably, said angle 28 can be about 45°, which may be facilitated by forming the housings 10 as a substantially octagonal prims and by arranging the film roll holder 3 as extending substantially transverse from one 14*c* of the side surfaces 14 of said housing 10. It is noted that it can be advantageously to position the central axis 9 of the film roll holder 3 under an angle, because gravitation can then facilitate that a lower end of the preconfigured film material 2 which during use is led through the sealing unit 5 can be pushed into said sealing unit 5 relatively well, whereas a string of manufactured gas filled cushions may still be steered relatively well into a horizontal orientation—in which it extends in substantially horizontal plane—due to a horizontal component of the material 2 fed through the said sealing unit 5.

Here, the film roll holders 3 are each provided with a roll 4 of preconfigured film material 2 and the housing 10 of each device 1 has a thickness exceeding the diameter of said roll 4. As is shown in positions 30 and 31 in FIG. 3, the roll 4 will then not grate over a lower surface 24*b* of said worktop. It is apparent that a horizontally extending roll will neither grate over a top surface 24 a of a worktop when said housing 10 is mounted with a mounting surface 11*a*, 11*e* on top of the worktop 24.

The invention also relates to a method for manufacturing gas filled cushions from preconfigured film material. In said method, the gas filled cushions are manufactured by means of a device 1 as disclosed herein and/or a stillage 23 such as a workbench provided with such device 1.

The invention is not restricted in any manner to the exemplary embodiments described above and represented in the accompanying drawing.

For example, all combinations of (parts of) embodiments described and/or shown are understood to fall within the inventive concept.

These and other embodiments will be apparent to the person skilled in the art and are considered to lie within the scope of the invention as formulated in the following claims.

The invention claimed is:

1. A device for manufacturing gas filled cushions from preconfigured film material, comprising:

a housing having a plurality of side surfaces, a film roll holder mounted to the housing for supporting a roll of preconfigured film material in a rotatable manner about a central axis, a gas supply unit, a sealing unit, and conveying means for conveying the film material away from the film roll holder and for conveying said film material along the gas supply unit and the sealing unit in a conducting direction, wherein the housing is configured to be mountable to a stillage in multiple positions such that:

a central axis of the film roll holder in one of said multiple positions will extend in a different direction with respect to a horizontal plane and/or with respect to a vertical plane than in another one of said multiple positions, wherein the housing includes multiple mounting surfaces and multiple fasteners facing in different directions and the multiple fasteners are configured for mounting the housing in said multiple position, wherein the housing is shaped as a prism;

wherein the housing includes two end faces and at least two side surfaces interconnecting the two end faces and the at least two side surfaces are configured as mounting surfaces;

wherein one end face of the two end faces of the prism shaped housing includes an input unit; and wherein the one end face and the input unit are cooperatively configured to permit an orientation of the input unit with respect to the one end face to be adjusted.

2. The device according to claim 1, wherein the housing is shaped as an octagonal prism.

3. The device according to claim 1, wherein the device is configured such that the conducting direction is in a direction parallel to a longitudinal direction extending from one end lace of the prism shaped housing to the other end face.

4. The device according to claim 1, wherein the input unit is releasably connected to the one end face of the prism shaped housing and wherein the one end face and the other end face of the two end faces are configured to enable releasing the input unit from the one end face and mounting the input unit to the other end face.

5. The device according to claim 1, wherein the central axis of the film roll holder extends transverse to one of the plurality of side surfaces of the housing.

6. The device according to claim 5, wherein the central axis of the film roll holder is positioned in the middle of the width of the one of the plurality of side surfaces seen in a direction transverse to a longitudinal direction extending from one end face of the prism shaped housing to the other end face.

7. The device according to claim 1, wherein the film roll holder includes a roll of preconfigured film material having an outer diameter and wherein the housing has a thickness that exceeds the outer diameter of the roll of preconfigured film material.

8. The device according to claim 1, wherein the prism is shaped as one of a regular prism, a right prism or a right regular prism.

9. The device according to claim 1, wherein each of the multiple fasteners is shaped as one of a mounting hole free of internal screw thread, a mounting hole provided with internal screw thread or a protruding screw bolt.

10. An assembly comprising the device of claim 1 and further comprising the stillage, wherein the housing is mounted to the stillage.

11. The assembly according to claim 10, wherein at least one of the plurality of side surfaces is mounted to the stillage.

12. The assembly according to claim 10, wherein the stillage has a horizontal plane and wherein the film roll holder is inclined at an angle with respect to the horizontal plane.

13. A method for manufacturing gas filled cushions from preconfigured film material, wherein the gas filled cushions are manufactured by use of the device according to claim 1.

* * * * *